United States Patent [19]

Correnti

[11] Patent Number: 4,815,774

[45] Date of Patent: Mar. 28, 1989

[54] UNIVERSAL DEAD BOLT

[76] Inventor: Frank Correnti, 1740 SW. 10th St., Boca Raton, Fla. 33486

[21] Appl. No.: 77,444

[22] Filed: Jul. 24, 1987

[51] Int. Cl.[4] ..... E05C 1/04

[52] U.S. Cl. ..... 292/145; 292/57

[58] Field of Search ..... 292/57, 67, 156, 162, 292/163, 145, 137, 175

[56] References Cited

U.S. PATENT DOCUMENTS

| | | | |
|---|---|---|---|
| 299,671 | 6/1884 | Neer | 292/175 X |
| 459,676 | 9/1891 | Daniel | 292/156 |
| 2,074,501 | 3/1937 | Cline | 292/175 X |
| 2,116,001 | 5/1938 | Schlage | 292/57 X |
| 3,706,164 | 12/1972 | Glause et al. | 292/175 X |
| 4,154,070 | 5/1979 | Bahry et al. | 292/142 X |

*Primary Examiner*—Richard E. Moore

*Attorney, Agent, or Firm*—Victor F. Volk

[57] ABSTRACT

A simple dead bolt is mounted inside sleeves which are aligned between a door and its door jam. One end of the dead bolt has a latch key projecting inside the room. The latch key can be mounted either on the door or in the wall. Sliding the latch key closed securely and rapidly locks the door from the inside.

3 Claims, 4 Drawing Sheets

9
4
8
8
20
13
5
5
22
23
24
12
21
21
21
14
11
15

UNIVERSAL DEAD BOLT

FIELD OF THE INVENTION

The present invention relates to securing a hinged door from the inside.

BACKGROUND OF THE INVENTION

It is a common practice to provide a lock for a hinged door. Certain type locks provide a securely locked door which is tamper proof from the outside. These locks thwart entry by the use of duplicate keys or jimmying devices. The present inventor patented such a door lock device in U.S. Pat. No. 4,629,229. There a flexible cable secured the inside door knob against the inside wall.

Dead bolt type door locks are also known. These devices teach the use of a straight bolt mounted across the door jam and the swinging side of the door. It is known in the art to mount such a dead bolt inside the door. The dead bolt is moved into the lock position by turning the handle on the inside of the door. A gear mechanism is required to convert the turning motion of the handle into the sliding motion of the dead bolt.

SUMMARY OF THE INVENTION

It is the object of the present invention to provide a quick throw latch key mechanism for closing a dead bolt.

Another object of the present invention is to provide a complete locking mechanism having a quick throw dead bolt.

Another object of the present invention is to provide a complete locking mechanism having a quick throw dead bolt which is universally mounted on variable width doors.

Another object of the present invention is to provide a complete locking mechanism having a quick throw latch key which further includes a safety catch to avoid accidental unlocking.

Other objects of this invention will appear from the following description and appended claims, reference being had to the accompanying drawings forming a part of this specification wherein like reference characters designate corresponding parts in the several views.

FIGS. *2a–2f* are plan views of component elements of the preferred embodiment of the universal dead bolt.

Figure 3:
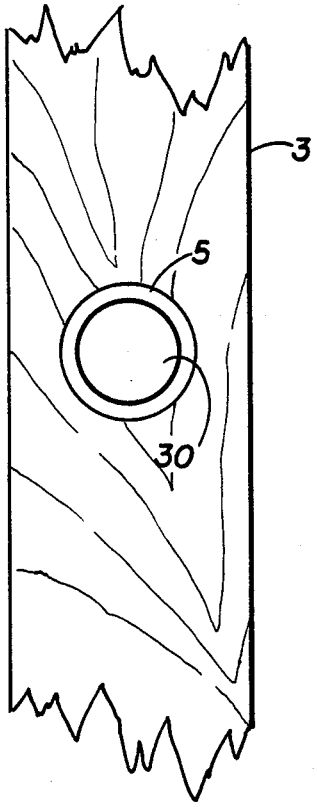

FIG. 3 is a longitudinal sectional view taken along line A—A of FIG. one.

Figure 4:
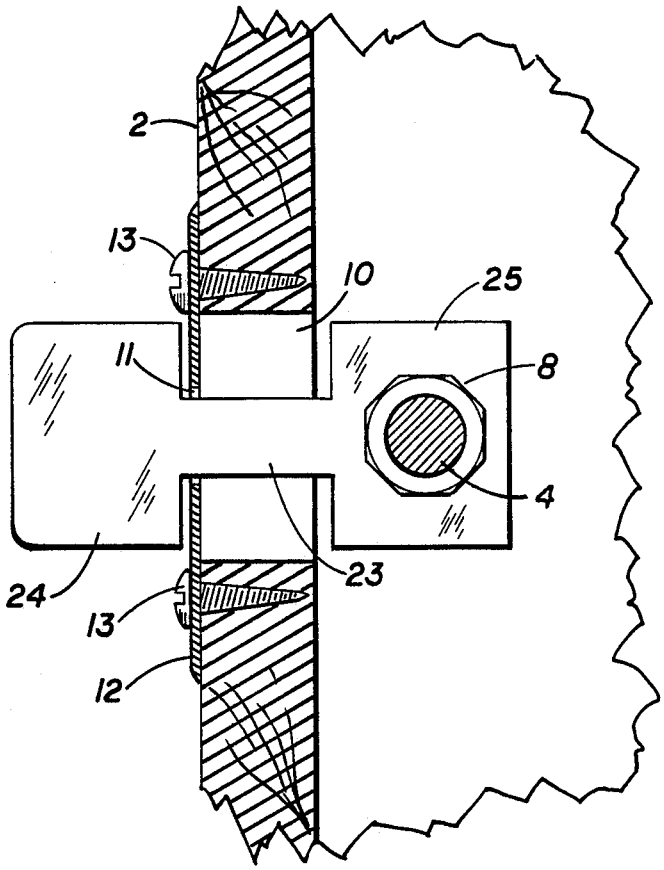

FIG. 4 is a longitudinal sectional view taken along line B—B of FIG. one.

Figure 1:
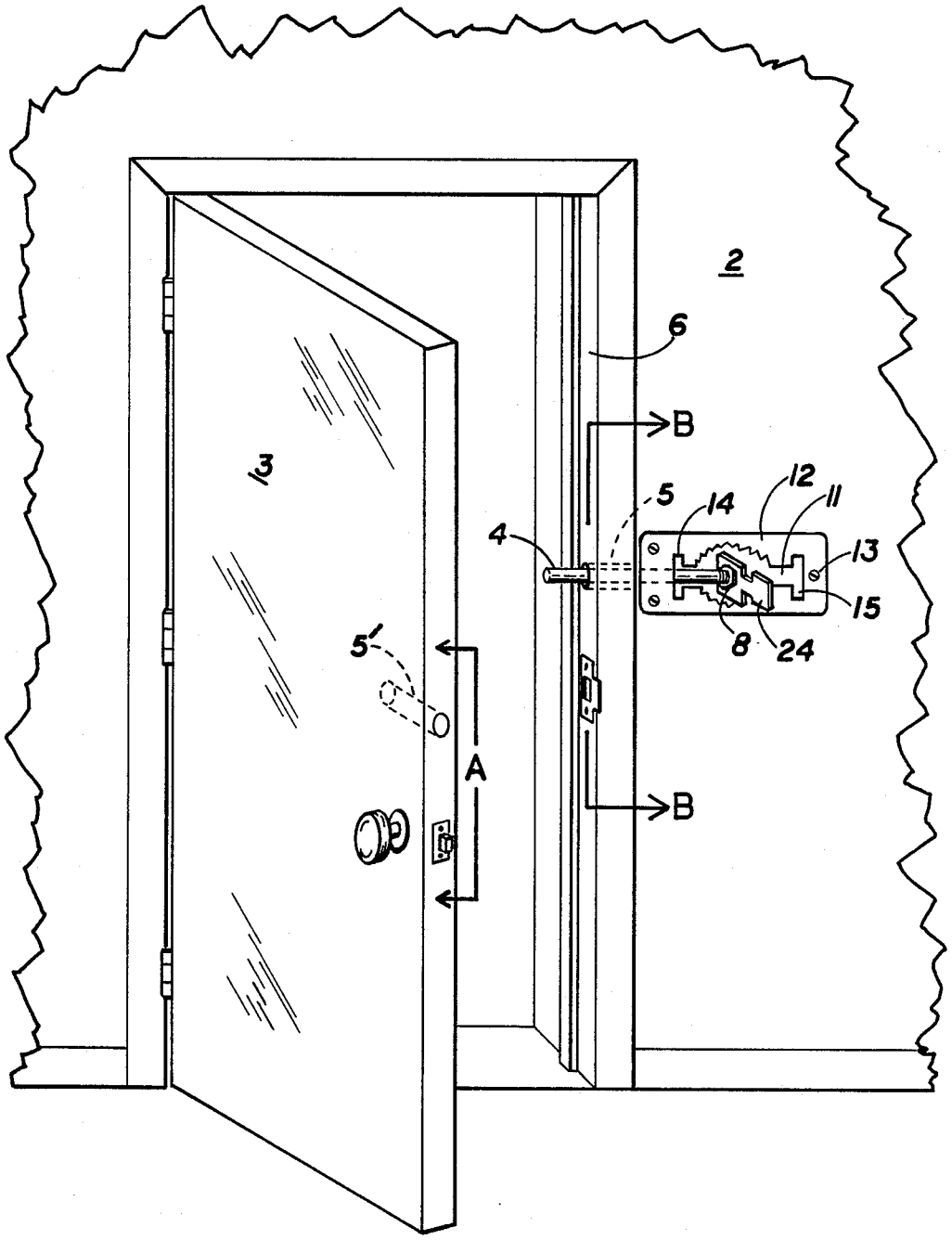
FIG. 1 is a front elevational view of the universal dead bolt installed on a wall. The view is from the inside of the room.
Figures 2A, 2B, 2C, 2D, 2E, 2F:
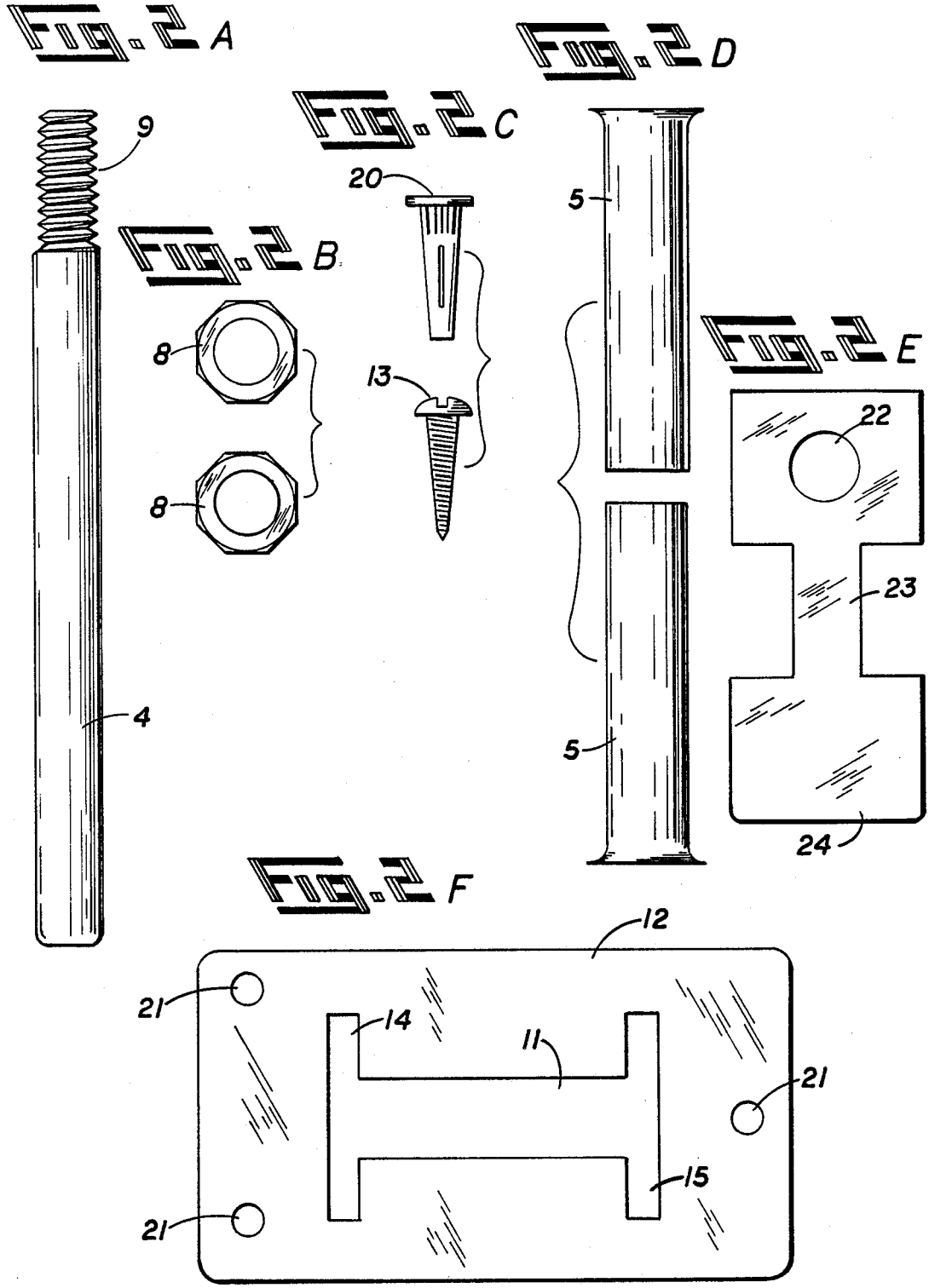
Figure 5:
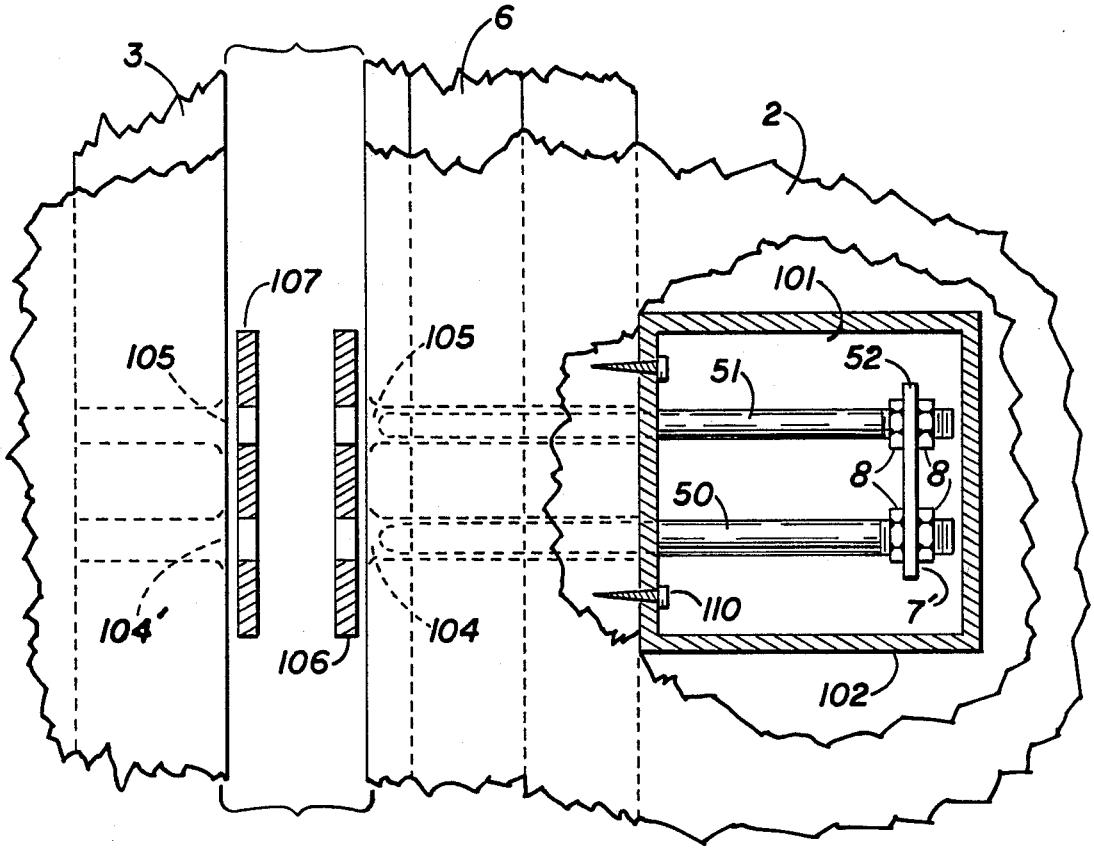

FIG. 5 is an elevation of a cut-away portion of the door and wall of FIG. 1 showing an embodiment with the mounting plate removed, having multiple dead bolts.

Before explaining the disclosed embodiment of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Referring first to FIG. 1, the universal dead bolt assembly 1 is mounted in wall 2. The universal dead bolt assembly 1 could alternatively be mounted inside door 3 (not shown).

A dead bolt 4 slides in sleeves 5 and 5'. When the door 3 is closed and the dead bolt 4 is moved into sleeve 5', the door 3 becomes securely locked. Sleeves 5 and 5' are mounted inside the door jam 6 and door 3 respectively.

A latch key 7 is bolted to one end of dead bolt 4 by bolts 8 and 8'. This latch key end of dead bolt 4 has threads 9 for bolts 8 and 8'. Latch key 7 slides through cutout 10 in wall 2 as shown in FIG. 4. Latch key 7 also slides through groove 11 of mounting plate 12 which is affixed to wall 2 by screws 13.

Latch key 7 is shown in the open position resting in safety catch 15. In order to move dead bolt 4 to the locked position, it is necessary to lift latch key 7 out of safety catch 15, then slide latch key 7 to the locked position, then drop latch key 7 into safety catch 14. Safety catch 14 ensures that dead bolt 4 will not be accidentally brushed open.

The basic principal of operation of universal dead bolt 1 relies on the center mounted sleeves 5 and 5'. An approximate ratio of three to one between the dead bolt 4 length and the length of groove 11 and sleeve 5' ensures a powerful dead bolt across door 3. The center mounted sleeves 5 and 5' remove any reliance on surface mounted screws 13 for strength. Only sleeves 5 and 5' and their respective mounting supports, door jam 6 and door 3, receive pressure during an attempted forced entry. Mounting plate 12 merely serves to hold latch key 7 in either the open or locked position.

FIGS. *2a–2f* shows all the parts of the preferred embodiment of the universal dead bolt assembly 1 shown in FIG. 1. The installation procedure is as follows.

First, mounting holes for sleeves 5 and 5' are drilled into door 3 and door jam 6 respectively. Next, a cutout 10 is chiseled into wall 2 in order to allow latch key 7 to slide (about two inches in the preferred embodiment). Cutout 10 must also be large enough to allow the mounting of nuts 8 and 8' onto threads 9 of dead bolt 4. Next, sleeves 5 and 5' are pushed into their respective holes. Then dead bolt 4 is inserted into sleeve 5 threads 9 first. Dead bolt 4 is inserted through hole 22 in latch key 7. Nuts 8 and 8' are tightened to allow adequate penetration of dead bolt 4 into sleeve 5' in the locked position. Plate 12 is affixed to wall 2 by screws 13 fitting into holes 21 and, if necessary, plugs 20.

A unique design feature of latch key 7 is the shank 23. The relatively narrow shank 23 in relation to the handle 24 and mounting end 25 allows this latch key 7 to be universally mountable in various width doors. Many installations mount the universal dead bolt assembly 1 of FIG. 1 in the door 3 rather than the wall 2 as shown.

FIG. 3 simply shows sleeve 5' mounted inside a hole 31 which has been drilled in door 3 as noted above. Sleeve 5' has a hollow center 30 into which dead bolt 4 slides in the locked position.

FIG. 4 shows how cutout 10 accommodates nut 8 and the mounting end 25 and shank 23 of latch key 7. the handle 24 of latch key 7 is readily available to quickly slide latch key 7 in groove 11 thereby locking door 3.

FIG. 5 shows an alternate embodiment of the universal dead bolt which has more than one dead bolt. Dead bolts 50 and 51 are affixed to latch key mounting end 52 by nuts 8 and 8'. Cutout 101 accommodates an optional mounting box 102. Screws 110 affix the mounting box 102 to wall 2. Latch key 7' operates in a similar fashion to FIGS. 1, 2, 3 and 4. Optional front plates 106 and 107 are used to reduce wear and tear on sleeves 104, 104', 105 and 105'. This embodiment makes the door 3 more resistant to a forced entry.

I claim:

1. A dead bolt lock system, comprising:

a wall;

a door hinged within said wall to open and close;

said door having a hole located in the center of the width thereof and parallel to the plane thereof;

said wall having a hole aligning with said hole in the door when said door is closed;

a sleeve in said hole in the door;

a sleeve in said hole in the wall;

a dead bolt slidingly engaged inside said sleeves when said door is closed;

said dead bolt having threads at the end which is in said door;

a handle for said dead bolt;

said handle further comprising a hole in one end wherein said hole is slidingly engaged around said threads of said dead bolt;

two nuts mounted on said threads of said dead bolt wherein said nuts affix said handle at a variable position on said dead bolt, thereby allowing adjustment of the protrusion of said dead bolt into said sleeve in said wall;

said handle further comprising an extended shank long enough to protrude beyond the surface of said door;

said handle further comprising a grip plate on the end opposite said hole;

a cover mounted over said dead bolt on said door;

said cover having a horizontal groove thereby allowing said extended shank to slide therein; and said horizontal groove having a notch at both ends to lock said extended shank in either notch, wherein sliding said handle back and forth locks and unlocks said door very securely by utilizing the full strength of said door to secure said sleeve in said hole in said door, and utilizing the full strength of said wall to secure said sleeve in said hole in said wall.

2. A dead bolt lock system, comprising:

a wall;

a door hinged within said wall to open and close;

said door having a hole located in the center of the width thereof and parallel to the plane thereof;

said wall having a hole aligning with said hole in the door when said door is closed;

a sleeve in said hole in the door;

a sleeve in said hole in the wall;

a dead bolt slidingly engaged inside said sleeves when said door is closed;

said dead bolt having threads at the end which is in said wall;

a handle for said dead bolt;

said handle further comprising a hole in one end wherein said hole is slidingly engaged around said threads of said dead bolt;

two nuts mounted on said threads of said dead bolt wherein said nuts affix said handle at a variable position on said dead bolt, thereby allowing adjustment of the protrusion of said dead bolt into said sleeve in said door;

said handle further comprising on extended shank long enough to protrude beyond the surface of said wall;

said handle further comprising a grip plate on the end opposite said hole;

a cover mounted over said dead bolt on said wall;

said cover having a horizontal groove thereby allowing said extended shank to slide therein; and said horizontal groove having a notch at both ends to lock said extended shank in either notch, wherein sliding said handle back and forth locks and unlocks said door very securely by utilizing the full strength of said solid door to secure said sleeve in said hole in said door, and utilizing the full strength of said wall to secure said sleeve in said hole in said wall.

3. A dead bolt lock system, comprising:

a wall;

a door hinged within said wall to open and close;

said door having two parallel holes located in the center of the width thereof and parallel to the plane thereof;

said wall having two holes aligning with said holes in the door when said door is closed;

a sleeve in each of said holes in the door;

a sleeve in each of said holes in the wall;

a dead bolt slidingly engaged inside each of said sleeves when said door is closed;

said dead bolts having threads at the ends which are in said wall;

a handle for said dead bolts;

said handle further comprising a hole in one end for each of said dead bolts, wherein said holes are slidingly engaged around said threads of said dead bolts;

two nuts mounted on said threads of said dead bolts wherein said nuts affix said handle at a variable position on said dead bolts, thereby allowing adjustment of the protrusion of said dead bolts into said sleeves in said door;

said handle further comprising an extended shank long enough to protrude beyond the surface of said wall;

said handle further comprising grip plate on the end opposite said holes;

a cover mounted over said dead bolt on said wall;

said cover having a horizontal groove thereby allowing said extended shank to slide therein; and said horizontal groove having a notch at both ends to lock said extended shank in either notch, wherein sliding said handle back and forth locks and unlocks said door very securely by utilizing the full strength of said solid door to secure said sleevs in said holes in said door, and utilizing the full strength of said wall to secure said sleeves in said holes in said wall.

* * * * *